United States Patent [19]

Sutton

[11] Patent Number: 4,642,019

[45] Date of Patent: Feb. 10, 1987

[54] HYDRAULIC CONTROL SYSTEM AND VALVE THEREFOR

[75] Inventor: Gary Sutton, Augusta, Ga.

[73] Assignees: General Signal Corporation, Stamford, Conn.; Dempster Systems, Inc., Knoxville, Tenn.

[21] Appl. No.: 683,823

[22] Filed: Dec. 19, 1984

[51] Int. Cl.[4] ..... B65F 3/00

[52] U.S. Cl. ..... 414/525 R; 91/516; 91/517

[58] Field of Search ..... 414/525 R; 91/189 R, 91/191, 516, 517

[56] References Cited

U.S. PATENT DOCUMENTS

| | | | |
|---|---|---|---|
| 2,916,050 | 12/1969 | Ruhl . | |
| 2,988,106 | 6/1961 | Rue . | |
| 3,006,372 | 10/1961 | Ruhl . | |
| 3,107,547 | 10/1963 | Vermeulen . | |
| 3,200,841 | 8/1965 | Beutler . | |
| 3,229,717 | 1/1966 | Rice . | |
| 3,410,427 | 11/1968 | McCarthy . | |
| 4,073,393 | 2/1978 | McKenzie et al. | 414/525 R |
| 4,180,365 | 12/1979 | Herpich et al. . | |

FOREIGN PATENT DOCUMENTS

| | | |
|---|---|---|
| 1446051 | 8/1976 | United Kingdom . |

*Primary Examiner*—Frank E. Werner

*Attorney, Agent, or Firm*—Harold Huberfeld; William G. Miller, Jr.

[57] ABSTRACT

A hydraulic control system is provided, including first and second bidirectional fluid actuated motors adapted to travel a predetermined amount in each direction. A directional control valve is placed in fluid communication with a supply of high pressure, hydraulic fluid and a reservoir and has a first operating position for directing the supply of fluid to the motors in a first direction of flow and a second operating position for directing the supply of fluid to the motors in a direction of flow opposite to the first direction of flow. A combination sequence and regeneration valve is in continuous fluid communication with the supply and the second motor for preventing the operation of the second motor until the first motor has reached its limit of travel and for regenerating fluid from one side of the second motor to the other side when the first motor has reached its limit of travel and the control valve is in its second operating position. The directional control valve and the combination sequence and regeneration valve are contained within a common housing having three motor passageways. The first two motor passageways cooperate with the directional control valve for providing bidirectional flow to the motors. The third motor passageway is in fluid communication with the combination sequence and regeneration valve for preventing fluid communication between the third motor passageway and the valve inlet passageway when the pressure on the inlet passageway is below a predetermined amount and for permitting fluid communication between the third motor passageway and the inlet passageway when the pressure in the inlet passageway exceeds that predetermined amount.

13 Claims, 3 Drawing Figures

24
26
28
50
58
34
62
70
72
64
54
98
92
96
94
88
80
76
22
56
84
86
90
78
74
82
68
60
66

HYDRAULIC CONTROL SYSTEM AND VALVE THEREFOR

BACKGROUND OF THE INVENTION

The present invention relates generally to hydraulic control systems for refuse compacting apparatuses, and more particularly to a simplified hydraulic control system and valve useful in such compacting apparatuses.

The use of hydraulically-powered devices for compacting refuse is well known. One such system is illustrated in FIG. 1. FIG. 1 shows a refuse compacting apparatus mounted on a truck and including a compaction chamber 10 and a refuse accumulating zone 12 communicating with the compaction chamber. A link panel 14 is mounted with the compaction chamber and is adapted to rotate therein about pivot point 16. A packer panel 18 is connected to the link panel and is adapted to rotate with respect to the link panel about pivot point 20. A hydraulic control system controls the movement of the link and packer panels to cause these panels to compact refuse in the compaction chamber and to move the refuse into the refuse accumulating zone. The hydraulic control system includes a supply of high pressure fluid on line 22, a fluid reservoir 24, and two cylindrical motors 26 and 28, each having pistons 30 and 32, respectively, arranged to reciprocate therein in response to fluid pressures on opposite sides of the piston. The first motor 26 has its rod end connected to the packer panel 18 and the second motor 28 has its rod end connected to the link panel 14. A directional control valve 34 has a first operating position 36 for placing the fluid supply in fluid communication with the head end of motor 26 with the rod end of motor 26 and the head end of motor 28 being placed in fluid communication with reservoir 24. The rod end of motor 28 is connected to the supply through a sequence valve 38. The directional control valve 34 has a second operating position 40 for placing the rod and motor 26 and the head end of motor 28 in fluid communication with supply 22, with the head end of motor 26 being placed in fluid communication with reservoir 24. The head and rod ends of motor 28 are connected to a regenerative valve 42.

When the directional control valve 34 is in position 36, fluid will be delivered from supply line 22 to the head end of packer motor 26 with fluid in the rod end of packer motor 26 being delivered to tank 24. The packer motor will continue to operate, rotating packer panel 18 with respect to link panel 14 until the motor reaches its limit of travel. At this point pressure will build up in the head end of motor 26 until a predetermined threshold pressure is reached, causing sequence valve 38 to trip connecting supply 22 to the rod end of link motor 28. Since the head end of motor 28 is connected to reservoir 24, the motor 28 rotates the link panel 14 upward in the compaction chamber, causing the packer panel 18 to push the refuse into the accumulating zone 12. The directional control valve 34 is then shifted by the operator into position 40, causing fluid to be supplied to the rod side of packer motor 26 with the head side of motor 26 being connected to reservoir 24. Simultaneously the head side of link motor 28 is connected to the fluid supply but the rod side of motor 28 is temporarily blocked from evacuating fluid by sequence valve 38 and regenerative valve 42. The packer motor 26 continues to retract until it has reached its limit of travel, causing the packer panel 18 to rotate back into the compaction chamber. Pressure will then build up in the head end of motor 28 until a predetermined threshold level is reached, typically the same as the threshold level for sequence valve 38, causing regenerative valve 42 to trip, placing the rod end of motor 28 in fluid communication with its head end, thus completing a regenerative circuit which will permit the motor 28 to rotate the link panel downward in compaction chamber 10 until it returns to its rest position.

Such prior circuits have worked satisfactorily, but have contained a large number of hydraulic components, and have thus been costly to build and operate.

SUMMARY OF THE INVENTION

A hydraulic control system for a refuse compacting apparatus is provided with first and second bidirectional fluid actuated motors adapted to travel a predetermined amount in each direction. A directional control valve in fluid communication with a supply of high pressure, hydraulic fluid and a fluid reservoir has a first operating position for directing the supply of fluid to the motors in a first directional flow and a second operating position for directing the supply of fluid to the motors in a direction of flow opposite to the first directional flow. A combination sequence and regeneration valve is in continuous fluid communication with the supply and the second motor for preventing the operation of the second motor until the first motor has reached its limit of travel and for regenerating fluid from one side of the second motor to the other side, when the first motor has reached its limit of travel and the control valve is in its second operating position.

The control valve includes a housing having an inlet passageway, an exhaust passageway and two motor passageways. The control valve further includes a moveable valve element, having a first position in which one motor passageway is placed in fluid communication with the inlet passageway and the other motor passageway is placed in fluid communication with the exhaust passageway. The moveable valve element has a second position in which the other motor passageway is placed in fluid communication with the inlet passageway and the first motor passageway is placed in fluid communication with the exhaust passageway. In a third position, the moveable valve element isolates each motor passageway from the other three passageways. The control valve further includes a third motor passageway in the housing and a valve in fluid communication with the third motor passageway and the inlet passageway for preventing fluid communication between the motor passageway and the inlet passageway when the pressure in the inlet passageway is below a predetermined amount and for permitting fluid communication between the third motor passageway and the inlet passageway and the pressure in the inlet passageway exceeds the predetermined amount.

OBJECTS OF THE INVENTION

An object of the present invention is the provision of a hydraulic control system for a refuse compacting apparatus which utilizes a minimum number of components.

Another object of the present invention is the provision of a hydraulic control system for a refuse compacting apparatus which is relatively inexpensive to manufacture.

A further object of the present invention is the provision of a hydraulic control system for a refuse compacting apparatus in which as many components as possible are contained within a single valve housing.

Another object of the present invention is the provision of a hydraulic control system for a refuse compacting apparatus which utilizes a minimum number of control pressure settings.

Other objects, advantages, and novel features of the present invention will become apparent from the following detailed description of the invention when considered in conjunction with the accompanying drawings.

DESCRIPTION OF THE PREFERRED EMBODIMENT

Figure 1:
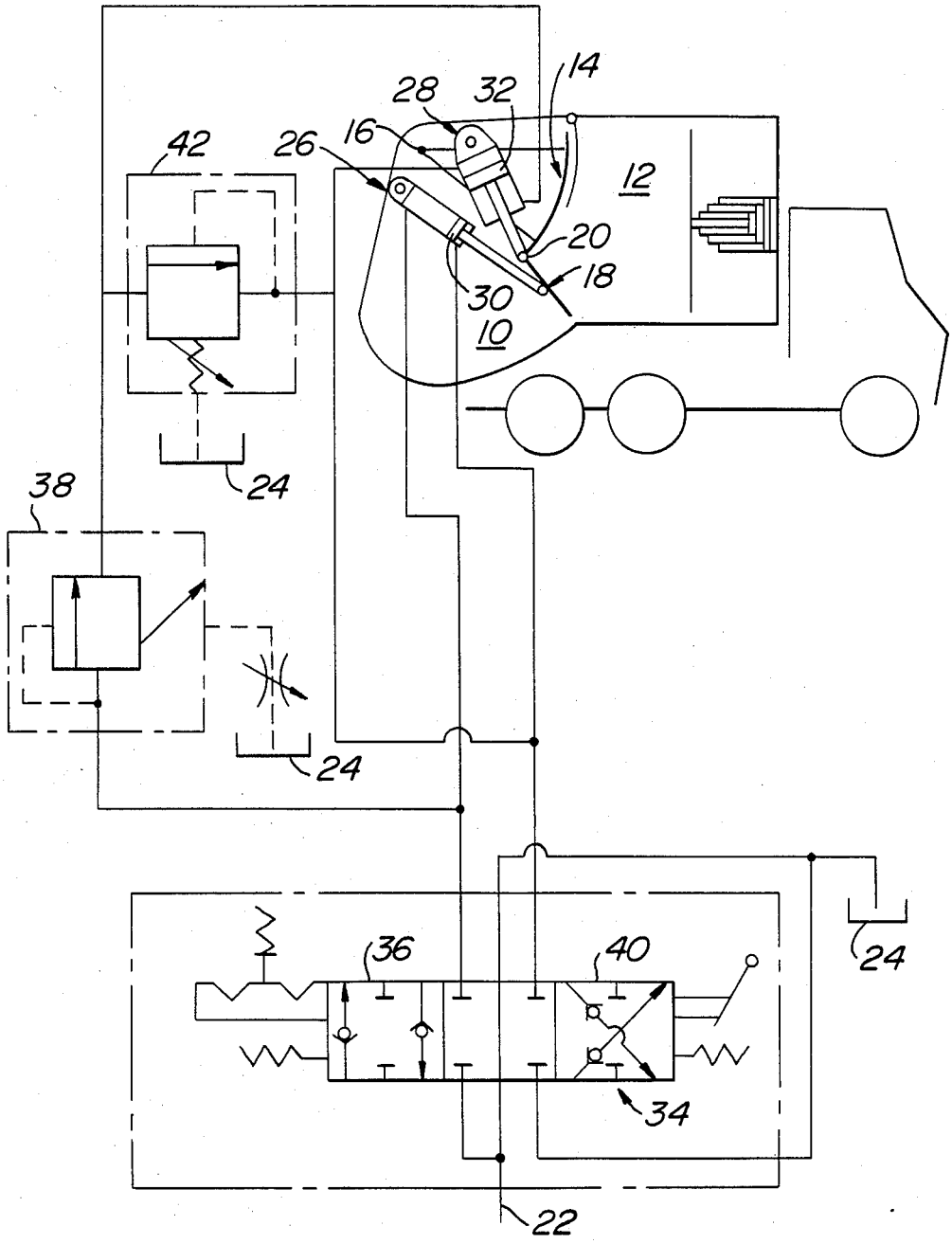
PRIOR ART FIG. 1
FIG. 1 shows a hydraulic control system for a refuse compacting apparatus in graphic form with said hydraulic control system being of a type that is known in the art.
Figure 2:
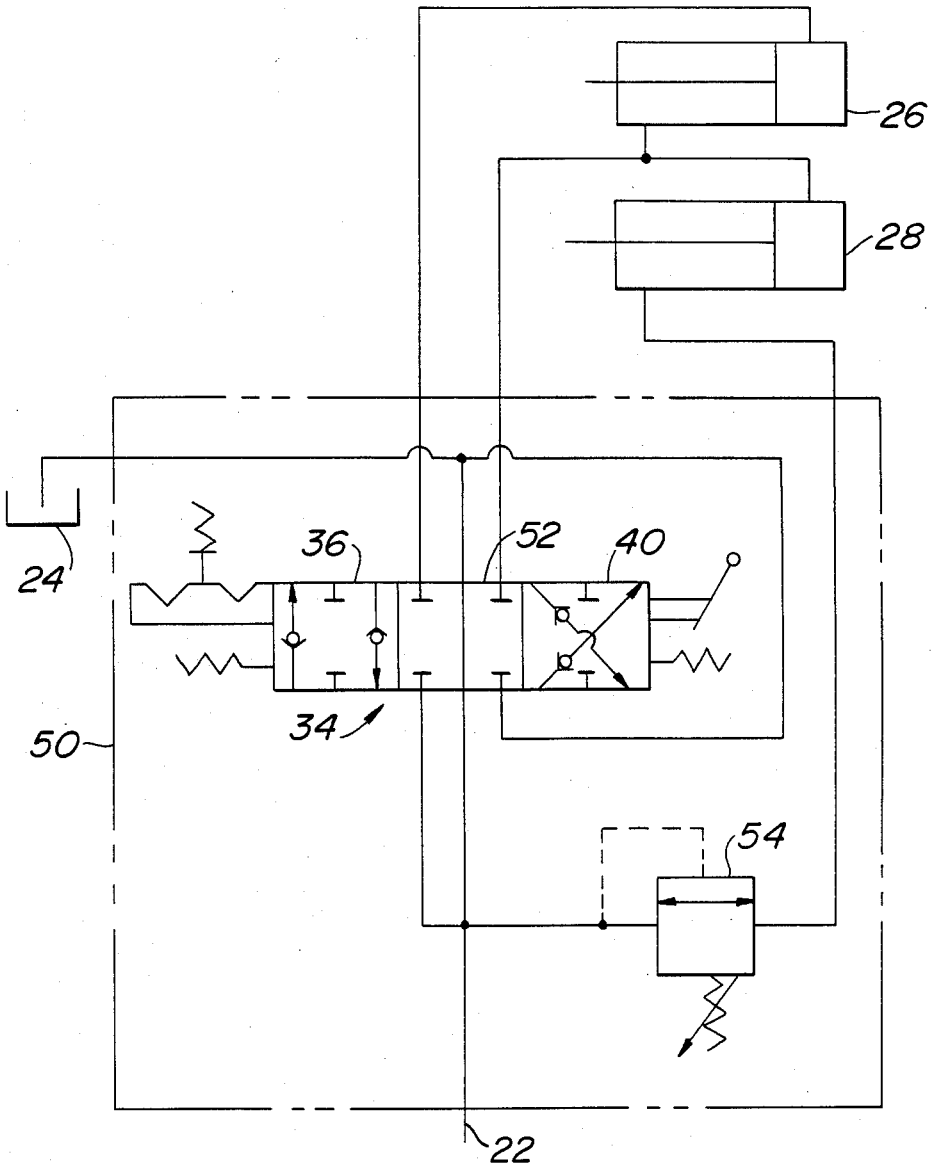
FIG. 2 shows in graphic form the hydraulic control system of the present invention.

The hydraulic control system of the present invention is shown in FIG. 2 with like numerals being utilized to identify components that are the same as those used in the prior circuit shown in FIG. 1. The supply of high pressure hydraulic fluid 22 is delivered by a pump (not shown). Typically, the valves contained within a housing 50 will be located downstream of other hydraulic controls unrelated to the compacting apparatus of the present invention with the supply 22 being a high pressure carry-over from upstream valves. As described earlier, the packer motor 26 and the link motor 28 are preferably cylindrical motors having a piston arranged to reciprocate therein in response to fluid pressure on opposite sides of the piston. Although a single packer motor 26 and link motor 28 and are shown for ease of illustration, it should be understood that the present invention contemplates the use of a plurality of such motors in tandem. The directional control valve 34 in its first operating position 36 places the supply 22 in fluid communication with the head end of packer motor 26, while placing the rod end of motor 26 and the head end of link motor 28 in fluid communication with reservoir 24. In its second operating position 40, the valve 34 places the rod end of packer motor 26 and the head end of link motor 28 in fluid communication with the supply 22 and places the head end of packer motor 26 in fluid communication with the reservoir 24. The directional control valve 34 further includes a neutral position 52, for placing the supply 22 in fluid communication with the reservoir 24. One of the novel features of the present invention is the provision of a combination sequence and regeneration valve 54 in continuous fluid communication with the supply 22 and the rod end of link motor 28. As will become apparent from the ensuing description of operation, the combination sequence and regeneration valve 54 permits fluid communication between the supply and the rod end of link motor 28 when the directional control valve 34 is in its first operating position 36 and when the pressure in the head end of packer motor 26 exceeds a predetermined amount. The combination sequence and regeneration valve 54 also permits fluid communication between the head end of link motor 28 and its rod end when the directional control valve 34 is in its second operating position 40 and when the pressure in the head end of link motor 28 and the rod end of packer motor 26 exceeds the same predetermined amount. Furthermore, when the directional control valve 34 is in its neutral position 52, the combination of sequence and regeneration valve 54 prevents fluid communication between the supply 22 and the rod end of link motor 28.

In the quiescent state, the valve 34 is placed in its neutral position 52 connecting the supply 22 with the reservoir 24. When it is desired to compact refuse, the operator first places the valve 34 in position 36, causing the delivery of fluid from supply 22 to the head end of packer motor 26 with the rod side of packer motor 26 being connected to tank 24. The packer motor 26 will continuously operate until it reaches its limit of travel. At this point pressure builds up in the head end of packer motor 26 until it reaches a predetermined level, preferably 1,250 psi above the pressure in reservoir 24. When this predetermined threshold pressure is reached, sequence and regeneration valve 54 opens, connecting the rod end of link motor 28 with the supply. Since the head end of link motor 28 is connected to reservoir 24, link motor 28 is now able to complete its cycle. Thus, in this first mode of operation the valve 54 operates as a sequence valve which prevents the operation of the link motor 28 until the packer motor 26 has reached its limit of travel.

Once the link motor 28 has reached its limit of travel the operator then shifts the valve 34 to its second operating position 40. Fluid is now supplied to the rod end of packer motor 26 with the head end of packer motor 26 being connected to reservoir 24. Simultaneously, fluid is supplied to the head end of link motor 28. However, fluid is prevented from flowing out of the rod end of link motor 28 by the valve 54. Pressure continues to build up in the head end of link motor 28 until the aforementioned threshold pressure is reached, at which point valve 54 opens, permitting the fluid from the rod end of motor 28 to combine with the flow of supply fluid in regenerating to the head end of motor 28. Thus, the link motor 28 is permitted to complete its cycle. Thus, in this second mode of operation the valve 54 first operates as a sequence valve in preventing the operation of the link motor 28 until the packer motor 26 has reached its limit of travel and then operates as a regenerative valve in permitting the link motor 28 to complete its cycle. It is further apparent when comparing the hydraulic control circuit of the present invention with the prior circuit illustrated in FIG. 1 that the combination sequence and regeneration valve 54 is performing the functions of both the sequence valve 38 and the regeneration valve 42 in the FIG. 1 circuit. Furthermore, the use of a single valve to perform both functions requires but a single control pressure setting.

Figure 3:
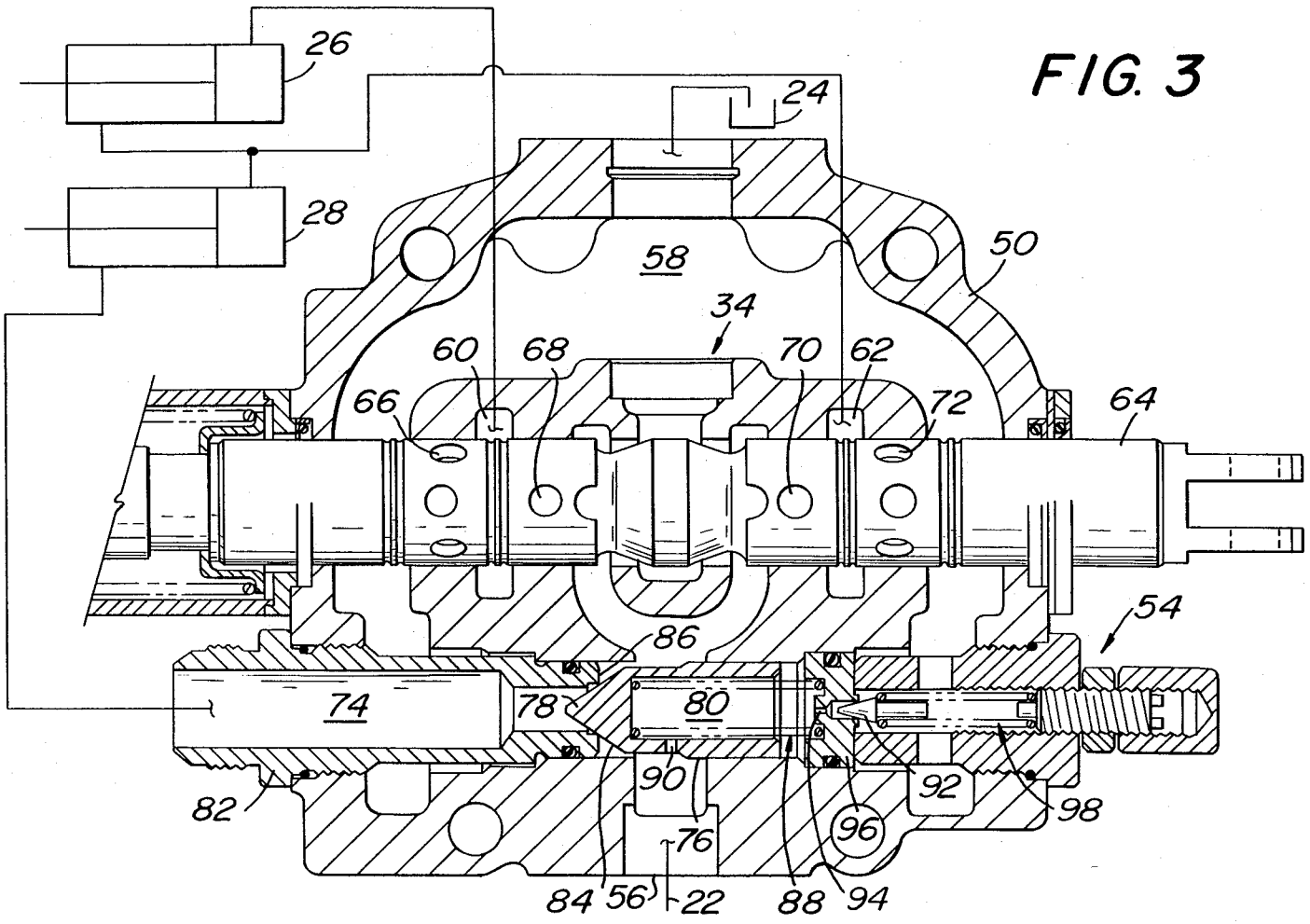
FIG. 3 shows in partial cross-section and in partial graphic representation, the hydraulic valves of the control system shown in FIG. 2.

As is clearly shown in FIG. 3, the directional control valve 34 and the combination sequence and regeneration valve 54 are contained within a common housing 50, having an inlet passageway 56, an exhaust passageway 58, two motor passageways 60 and 62, and a moveable valve element 64. The moveable valve element 64 preferably contains hollow portions and includes a plurality of sets of ports 66, 68, 70 and 72 with the hollow portions of element 64 connecting ports 66 with ports 68 and connecting ports 70 with ports 72. In its first operating position, moveable valve element 64 is shifted to the right, aligning ports 66 with motor passageway 60, ports 68 with inlet passageway 56, ports 70 with motor passageway 62 and ports 72, with exhaust passageway 58. In its second operating position, the shiftable valve element 64 is moved to the left, aligning ports 66 with exhaust passageway 58, ports 68 with motor passageway 60, ports 70 with inlet passageway 56 and ports 72 with motor passageway 62. In the position illustrated in FIG. 3, the shiftable valve element 64 is in its neutral position in which the motor ports 60 and 62 are isolated from each other and from the inlet passageway 56 and the exhaust passageway 58. In the neutral position, the inlet passageway 56 is placed in direct fluid communication with the exhaust passageway 58.

Another novel feature of the present invention is the provision of a third motor passageway 74; in the housing 50. The combination sequence and regeneration valve 54 is in fluid communication with the third motor passageway 74 and the inlet passageway 56 for preventing fluid communication between the third motor passageway and the inlet passageway when the pressure in the inlet passageway is below a predetermined amount and for permitting fluid communication between the third motor passageway and the inlet passageway when the pressure in the inlet passageway exceeds that predetermined amount. It should be noted that regardless of the position of the moveable valve element 64, the motor passageway 74 is isolated from the exhaust passageway 58. The combination sequence and regeneration valve 54 includes a valve element 76 which is closed at one end 78 and includes a hollow interior portion 80. The motor passageway 74 is formed by the insertion of sleeve 82 into housing 50. The tapered outer surface 84 of end 78 of valve element 76 is biased into sealing engagement with the end 86 of sleeve 82 by a spring 88. An orifice 90 is located in the wall of valve element 76 in fluid communication with both the inlet passageway 56 and the hollow interior 80 of valve element 76. The valve 54 further includes a pilot poppet valve 92, which is placed in fluid communication with the hollow interior 80 of valve element 76 by an orifice 94 in plug 96. The pilot poppet 92 is biased into sealing engagement with the end of the plug 96 by spring 98 which is sized to permit the poppet 92 to open and place the hollow interior 80 of valve element 76 in fluid communication with exhaust passageway 58 when the pressure in the hollow interior 80 exceeds a predetermined amount which is lower than the threshold pressure required to unseat valve element 76. For example, the pilot poppet 92 is preferably designed to open when the pressure in hollow interior 80 of valve element 76 reaches 1,000 psi. Once the pilot poppet 92 opens, a flow path is created from in the passageway 56 through orifice 90, hollow interior 80, orifice 94, past pilot poppet 96 and into exhaust passageway 58. This pilot flow creates a pressure drop across orifice 90. When that pressure drop reaches, for example, 250 psi, at which point the pressure at inlet 56 will be 1,250 psi, the valve element 76 is sized to open, permitting fluid communication between motor port 74 and inlet passageway 56.

As is illustrated graphically in FIG. 3 in the hydraulic control system of the present invention, the exhaust passageway 58 is connected to reservoir 24, motor passageway 60 is connected to the head end of packer motor 26, motor passageway 62 is connected to the rod end of packer motor 26 and the head end of link motor 28, and motor passageway 74 is connected to the rod end of link motor 28.

Thus, in the operation of the hydraulic control circuit of the present invention, when the moveable valve element 64 is in the neutral position, as shown, the valve element 76 prevents fluid communication between motor passageway 74 and inlet passageway 56. When the moveable valve element 64 is moved to its first operating position, fluid is delivered from supply 22 through inlet passageway 56, ports 68, ports 66, and motor passageway 60 to the head end of packer motor 26. The rod end of packer motor 26 and the head end of link motor 28 are connected to the reservoir 24 by means of motor passageway 62, ports 70 and 72, and exhaust passageway 58. Until the packer motor 26 reaches its limit of travel, inlet passageway 56 is isolated from motor passageway 74 by valve elements 76. However, when the packer motor 26 reaches its limit of travel, and pressure begins to build up in the head end of packer motor 26, that pressure will be communicated to the inlet passageway 56. When the pressure in the inlet passageway 56 reaches approximately 1,000 psi, pilot poppet 92 will open, and when that pressure reaches 1,250 psi valve element 76 opens, permitting the supply of fluid from inlet passageway 56 through motor passageway 74 to the rod end of link motor 28.

Once the link motor 28 has completed its cycle, the moveable valve element 64 may be shifted to the left to its second operating position, supplying fluid from inlet passageway 56 through ports 70 and 72 and motor passageway 62 to the rod end of packer motor 26 at the head end of link motor 28. The head end of packer motor 26 is connected to reservoir 24 through motor passageway 60, ports 68 and 66 and exhaust passageway 58. When the packer motor 26 has reached this limit of travel, pressure builds up in the rod end of packer motor 26 and is transmitted to inlet passageway 56. When this pressure reaches 1,000 psi, pilot poppet 92 opens, and when the pressure reaches possible 1,250 psi, valve element 76 opens, permitting fluid from the rod end of link motor 28 to combine with supplying fluid in inlet passageway 56 in communicating with the head end of link motor 28 through ports 70 and 72 and motor passageway 62.

Thus, it is apparent that the hydraulic control system and control valve of the present invention provide a system which is relatively simple and inexpensive to manufacture, results in a considerable reduction of parts from prior systems, and utilizes only one control pressure setting.

While there has been described at present considered to be the preferrd embodiment of the present invention, it will be obvious to those skilled in the art that various changes and modifications may be made therein, without departing from the invention. And it is, therefore, aimed in the appended claims to cover all such changes and modifications that fall within the true spirit and scope of the invention.

What is claimed is:

1. A hydraulic control system comprising:

a supply of high pressure hydraulic fluid;

a fluid reservoir for storing fluid at a pressure substantially below said supply fluid pressure;

first and second bi-directional fluid actuated motors adapted to travel a predetermined amount in each direction;

a directional control valve in fluid communication with said supply and said reservoir, having a first operating position for directing said supply of fluid to said motors in a first direction of flow and an opposite second operating position for directing said supply of fluid to said motors in a direction of flow opposite to said first direction of flow; and a combination sequence and regeneration valve in continuous fluid communication with said supply and one side of said second motor and selectively placed into and out of fluid communication with said first motor and the other side of said second motor by said directional control valve for preventing the operation of said second motor until said first motor has reached its limit of travel and for regenerating fluid from said one side of said second motor to the other side when said first motor has reached its limit of travel and said control valve is in its second operating position.

2. A hydraulic control system as set forth in claim 1 wherein said combination sequence and regeneration valve prevents the operation of said second motor until said first motor has reached its limit of travel when said control valve is in either its first or second operating positions.

3. A hydraulic control system as set forth in claim 1 wherein said directional control valve further includes a neutral position for placing said supply in fluid communication with said reservoir and wherein said combination sequence and regeneration valve prevents fluid communication between said supply and said one side of said second motor when said directional control valve is in said neutral position.

4. A hydraulic control system as set forth in claim 1 wherein said directional control valve and said combination sequence and regeneration valve are contained within a common housing, said housing having a first passageway in fluid communication with one side of said first motor, a second passageway in fluid communication with the other side of said first motor and the other side of said second motor and a third passageway in fluid communication with said one side of said second motor.

5. A hydraulic control system as set forth in Claim 4 wherein said control valve further includes a moveable valve element for controlling the flow through said first and second passageways, wherein said housing further includes an inlet in fluid communication with said supply and wherein said combination sequence and regeneration valve places said third passageway in fluid communication with said inlet and said moveable valve element when the pressure at said inlet exceeds a predetermined amount.

6. A hydraulic control system comprising:

a supply of high pressure hydraulic fluid;

a fluid reservoir for storing fluid at a pressure substantially below said supply fluid pressure;

first and second fluid actuated cylindrical motors each having a piston arranged to reciprocate therein in response to fluid pressure on opposite sides of said piston;

a directional control valve having a first operating position for placing said supply in fluid communication with one side of the piston in said first motor and for placing the other side of the piston in said first motor and one side of the piston in said second motor in fluid communication with said reservoir and an opposite second operating position for placing the other side of the piston in said first motor and said one side of the piston in said second motor in fluid communication with said supply and for placing said one side of the piston in said first motor in fluid communication with said reservoir; and a combination sequence and regeneration valve in continuous fluid communication with said supply and the other side of the piston in said second motor for:

(a) permitting fluid communication between said supply and the other side of the piston in said second motor when said directional control valve is in said first operating position and when the pressure on said one side of the piston in said first motor exceeds a predetermined amount, and (b) permitting fluid communication between the other side of the piston in said second motor and said one side of the piston in said second motor when said directional control valve is in said second operating position and when the pressure on the other side of the piston in said first motor and said one side of the piston in second motor exceeds said predetermined amount.

7. A hydraulic control system as set forth in claim 6 wherein said directional control valve further includes a neutral position for placing said supply in fluid communication with said reservoir and wherein said combination sequence and regeneration valve prevents fluid communication between said supply and the other side of the piston in said second motor when said directional control valve is in said neutral position.

8. A hydraulic control system as set forth in claim 6 wherein said directional control valve and said combination sequence and regeneration valve are contained within a common housing, said housing having a first passageway in fluid communication with one side of the piston in said first motor, a second passageway in fluid communication with the other side of the piston in said first motor and said one side of the piston in said second motor and a third passageway in fluid communication with the other side of the piston in said second motor.

9. A hydraulic control system as set forth in claim 8 wherein said control valve further includes a moveable valve element for controlling the flow to said first and second passageways, wherein said housing further includes an inlet in fluid communication with said supply and wherein said combination sequence and regeneration valve places said third passageway in fluid communication with said inlet and said moveable valve element when the pressure at said inlet exceeds said predetermined amount.

10. A refuse compacting apparatus comprising:

(a) a compaction chamber, (b) a refuse accumulating zone communicating with said chamber, (c) a link panel mounted within said compaction chamber and adapted to move with respect thereto, (d) a packer panel connected to said link panel and adapted to move with respect thereto and, (e) a hydraulic control system for controlling the movement of said link and packer panels to cause said link and packer panels to compact refuse in said compaction chamber and move said refuse into said refuse accumulating zone, said hydraulic control system including a supply of high pressure hydraulic fluid, a fluid reservoir for storing fluid at a pressure substantially below said supply fluid pressure, first and second fluid actuated cylindrical motors each having a piston arranged to reciprocate therein in response to fluid pressure on opposite sides of said piston, said first motor being connected to said packer panel and said second motor being connected to said link panel, a directional control valve having a first operating position for placing said supply in fluid communication with one side of the piston in said first motor and for placing the other side of the piston in said first motor and one side of the piston in said second motor in fluid communication with said reservoir, and an opposite second operating position for placing the other side of the piston in said first motor and said one side of the piston in said second motor in fluid communication with said supply and for placing said one side of the piston in said first motor in fluid communication with said reservoir, and a combination sequence and regeneration valve in continuous fluid communication with said supply and the other side of the piston in said second motor for permitting fluid communication between said supply and the other side of the in said second motor when said directional control valve is in said first operating position and when the pressure on said one side of the piston in said first motor exceeds a predetermined amount, and permitting fluid communication between the other side of the piston in said second motor and said one side of the piston in said second motor when said directional control valve is in said second operating position and when the pressure on the other side of the piston in said first motor and said one side of the piston in said second motor exceeds said predetermined amount.

11. A refuse compacting apparatus as set forth in claim 10 wherein said directional control valve further includes a neutral position for placing said supply in fluid communication with said reservoir and wherein said combination sequence and regeneration valve prevents fluid communication between said supply and the other side of the piston in said second motor when said directional control valve is in said neutral position.

12. A refuse compacting apparatus as set forth in claim 10 wherein said directional control valve and said combination sequence and regeneration valve are contained within a common housing, said housing having a first passageway in fluid communication with one side of the piston in said first motor, a second passageway in fluid communication with the other side of the piston in said first motor and said one side of the piston in said second motor and a third passageway in fluid communication with the other side of the piston in said second motor.

13. A refuse compacting apparatus as set forth in claim 12 wherein said control valve further includes a moveable valve element for controlling the flow to said first and second passageways, wherein said housing further includes an inlet in fluid communication with said supply and wherein said combination sequence and regeneration valve places said third passageway in fluid communication with said inlet and said moveable valve element when the pressure at said inlet exceeds a predetermined amount.

* * * * *